US009681684B2

(12) United States Patent
Matern et al.

(10) Patent No.: US 9,681,684 B2
(45) Date of Patent: Jun. 20, 2017

(54) APPARATUS, METHOD AND MACHINE FOR PRODUCING AN ENDLESS FILTER ROD OF THE TOBACCO PROCESSING INDUSTRY

(71) Applicant: HAUNI MASCHINENBAU AG, Hamburg (DE)

(72) Inventors: Oliver Matern, Hamburg (DE); Christian Wichmann, Geesthacht (DE); Patrick Fricke, Hamburg (DE); Heiko Hoffleit, Boernsen (DE)

(73) Assignee: HAUNI Maschinenbau GmbH, Hamburg (DE)

( * ) Notice: Subject to any disclaimer, the term of this patent is extended or adjusted under 35 U.S.C. 154(b) by 537 days.

(21) Appl. No.: 14/192,154

(22) Filed: Feb. 27, 2014

(65) Prior Publication Data

US 2014/0243178 A1 Aug. 28, 2014

(30) Foreign Application Priority Data

Feb. 28, 2013 (DE) ..... 10 2013 203 349
Jun. 27, 2013 (DE) ..... 10 2013 212 416

(51) Int. Cl.
*A24D 3/02* (2006.01)

(52) U.S. Cl.
CPC ..... *A24D 3/0237* (2013.01); *A24D 3/0216* (2013.01)

(58) Field of Classification Search
CPC ..... A24D 3/0237; A24D 3/0216
USPC ..... 493/39, 42, 46, 47, 50
See application file for complete search history.

(56) References Cited

U.S. PATENT DOCUMENTS 3,050,430 A * 8/1962 Gallagher ..... A24D 3/0233 131/84.3
3,079,930 A * 3/1963 Cobb, Jr. ..... A24D 3/022 131/343
3,546,325 A * 12/1970 Muller ..... A24D 3/0237 131/216

(Continued)

FOREIGN PATENT DOCUMENTS

DE 42 40 089 6/1994
DE 100 10 176 2/2001

(Continued)

OTHER PUBLICATIONS

German Office Action conducted in counterpart German Appln. No. 10 2013 203349.4 (Jan. 9, 2014).

*Primary Examiner* — Sameh Tawfik
(74) *Attorney, Agent, or Firm* — Greenblum & Bernstein, P.L.C.

(57) ABSTRACT

Apparatuses and methods for producing an endless filter rod of the tobacco processing industry. An embodiment of the apparatus includes a transport nozzle loadable with compressed air, a guide tube, an elongated rod, which is arranged in the guide tube, having a rod projection, and an infeed roller, which is non-driven and freely rotatable, positioned immediately at an end of the transport nozzle and at a distance to the rod, and has a bearing surface that defines in sections a conveying path of a filter material web. The apparatus also includes a guide element positioned between the infeed roller and the rod by which a cross-section of the filter material web is reduced between the rod and the guide element in a region of the rod projection.

10 Claims, 6 Drawing Sheets

(56) References Cited

U.S. PATENT DOCUMENTS

| | | | | | |
|---|---|---|---|---|---|
| 4,281,671 | A * | 8/1981 | Bynre | A24D 3/0212 | 131/335 |
| 4,511,420 | A * | 4/1985 | Arthur | A24D 3/0295 | 131/84.1 |
| 4,549,875 | A * | 10/1985 | Pryor | A24D 3/022 | 493/44 |
| 5,163,452 | A * | 11/1992 | Marritt | A24D 3/0233 | 131/331 |
| 5,725,467 | A * | 3/1998 | Chehab | A24D 3/0204 | 493/42 |
| 7,770,585 | B2 * | 8/2010 | Fowles | A24D 3/022 | 131/331 |
| 8,652,020 | B2 * | 2/2014 | Davis | A24D 3/0212 | 131/274 |

FOREIGN PATENT DOCUMENTS

| | | |
|---|---|---|
| DE | 10 2010 043 350 | 5/2012 |
| DE | 20 2012 003 924 | 8/2013 |
| EP | 0 573 279 | 12/1993 |
| EP | 2 502 510 | 9/2012 |
| GB | 1 585 761 | 3/1981 |

* cited by examiner a)

b)

c)

a)

b)

APPARATUS, METHOD AND MACHINE FOR PRODUCING AN ENDLESS FILTER ROD OF THE TOBACCO PROCESSING INDUSTRY

CROSS-REFERENCE TO RELATED APPLICATIONS

The present application claims priority under 35 U.S.C. §119(a) of German Patent Application No. 10 2013 203 349.4 filed Feb. 28, 2013 and German Patent Application No. 10 2013 212 416.3 filed Jun. 27, 2013, the disclosures of which are expressly incorporated by reference herein in their entireties.

BACKGROUND OF THE INVENTION

1. Field of the Invention

Embodiments relate to an apparatus for producing an endless filter rod of the tobacco processing industry that includes a transport nozzle that can be loaded with compressed air and a guide tube with an elongated rod arranged in the guide tube. An infeed roller that is not driven but rotates freely is arranged directly at the end of the transport nozzle and at a distance to the rod, and a bearing surface of the infeed roller defines in sections the conveying path of the filter material web. Embodiments also relate to an endless filter rod machine and a method corresponding to the apparatus.

Thus, embodiments relate to the field of filter production, in particular to the production of filters with inserted objects, e.g., fluid-filled capsules. Such capsules are crushed by the user before the use of the cigarette, and while smoking the cigarette develop an additional flavor. Other types of objects can also be inserted, for example, further filter materials such as an active charcoal body, granulates, and the like can be inserted.

2. Discussion of Background Information

The most common method for inserting objects into an endless filter rod, in particular an endless filter rod made of acetate tow, includes that the objects are held at the periphery of an insertion wheel in object seats applied with suction air, and that plunge into the endless filter rod with the periphery of the insertion wheel in the course of the rotation of the insertion wheel. At the transfer point in the endless filter rod, the suction air is shut off and the object remains in the endless filter rod. For this purpose, the endless filter rod has a U-shaped cross-section at the transfer location so that the objects can be reliably inserted into the endless filter rod with low stress. An appropriate object insertion apparatus is known, for example, from the applicant's patent application EP 2 502 510 A1, the disclosure of which is expressly incorporated by reference herein in its entirety.

In order to bring the endless filter rod, or respectively the filter material web into the required U-shape, the filter material web, in particular the tow strip, is conveyed through a transport nozzle with an excess of compressed air. The transport nozzle, in addition to the drive of the conveyance, serves also for gathering the previously outspread filter material web into an endless rod shape with low density. The still loose endless rod is then inserted into a tow guide which is inserted from a guide tube with an elongated rod arranged inside, also called a plow. The combination of the rod and the guide tube arranged around it ensures that the loose endless filter rod in the guide tube wraps around the rod, and the endless filter rod thusly obtains the necessary U-shape into which subsequently the objects can be inserted from above.

With the apparatus according to the document EP 2 502 510 A1, the loose endless filter rod arrives after the conveyance through the transport nozzle on an infeed roller which turns the endless filter rod around and has a substantially U-shaped or V-shaped circumferential profile, that bends and folds the filter material while it runs over the infeed roller. The infeed roller has a relatively large radius of the bearing surface and is arranged at a distance from the beginning of the rod that is bridged by the endless filter rod. Here, the beginning of the rod means the end facing toward the transport nozzle, thus, the end located upstream in the conveying direction of the endless filter rod, also called rod projection and rod projection part in the following in the scope of the present invention. This section of the rod has a plow-like curvature and, where appropriate, a flat blade edge that serves for guiding the endless filter rod. The filter produced in this manner has a relatively low pressure drop compared to filters without capsules.

SUMMARY OF THE EMBODIMENTS

Embodiments of the invention address the above-noted drawbacks of the known art by increasing the pressure drop during the production of capsule filters and the endless rod speed.

Accordingly, embodiments are directed to an apparatus for producing an endless filter rod of the tobacco processing industry that includes a transport nozzle that can be loaded with compressed air and a guide tube with an elongated rod arranged in the guide tube. An in feed roller that is not driven but rotates freely is arranged immediately or directly at the end or the exit of the transport nozzle and at a distance to the rod, and a bearing surface of the infeed roller defines in sections the conveying path of a filter material web. Moreover, a further guide element is arranged between the infeed roller and the rod, by which a cross-section of the filter material web is reduced between the rod and the further guide element in the region of a rod projection of the rod.

The embodiments are based on the fundamental idea that via the further guide element, on the one hand, the distance between the infeed roller and the beginning of the rod, or respectively the rod projection or rod projection part, is bridged, and on the other hand the cross-section of the filter material web, or respectively the loose or respectively still loose endless filter rod, is reduced at the location of the rod projection. The bridging of the distance leads to increased smooth running of the endless filter rod, which leads to the fact that a higher endless rod speed can be used. The reduction of the cross-section of the filter material web between the rod and the further guide element ensures pre-compaction and pre-forming of the filter material such that with an already more strongly compacted filter material a U-shape is attained into which subsequently objects can be inserted. The finished product, thus the filter rods loaded with objects, hereby have an increased pressure drop compared to conventionally produced object filters, or respectively capsule filters.

The guide element is preferably designed as a freely rotatable, non-driven guide roller which is arranged, in particular, below the rod projection. The guide roller preferably has the same diameter of the bearing surface as that of the infeed roller, however, this can advantageously also be larger or smaller. Both the guide roller and the infeed roller are designed freely co-rotating and non-driven. This ensures that the circumferential speed of the bearing surface of the infeed roller and the guide roller corresponds to the endless rod conveying speed, and thus no excess frictional heat is generated due to slippage. The rollers, that is, the infeed roller and the guide roller, fulfill their function of guiding, pre-forming and pre-compaction of the endless filter rod in a gentle manner. The preferred arrangement below the rod projection leads to a compaction and reduction of the cross-section of the endless filter rod in the region of a rod projection of the rod, thus at the beginning of the rod, seen in the conveying direction of the endless rod.

The axis of rotation of the guide roller is advantageously arranged parallel to the axis of rotation of the infeed roller and offset downward in the direction of gravity. In this manner the two rollers, that is, the infeed roller and the guide roller, form a type of baffle between which the material web is slightly deflected twice. Here, the filter material web preferably takes a direct path between the rollers, thus contacting the infeed roller at the lower side thereof in the direction of gravity, and at the top side of the guide roller that is arranged behind and below.

In an alternative embodiment, the guide element is advantageously designed as a funnel, in particular a conical funnel, which opens into the guide tube. The funnel ensures a gentle guidance of the endless filter rod to the guide tube, and through the preferably substantially conical shape thereof ensures a pre-forming of the endless filter rod, or respectively filter material web, which has a curve in the cross-section, and thus is ideally preformed for the further formation of the U-shaped cross-section in the winding around the rod.

The infeed roller and/or the guide roller preferably have a bearing surface with a central peripheral ridge, the largest radius of which is greater than the smallest radius of the bearing surface by 10% to 100%, in particular by 20% to 50%. Here, the ridge is arranged such that the loose endless filter rod, which emanates from the transport nozzle, arrives centrally on the ridge, and thus obtains a curved cross-section. This pre-forming also provides a compaction of the material in the transverse direction such that a somewhat more strongly pre-compacted endless material rod is subsequently wrapped around the rod in the guide tube for the creation of the U-shaped cross-section. With this, the pressure drop of the fully produced filter rods is further increased.

In particular in the case that the guide element is designed as a funnel, but also in the case that the guide element is designed as a guide roller, it is advantageous if an air guide plate is arranged downstream of the transport nozzle and/or the infeed roller, upstream of the rod and above the conveying path of the endless filter rod. The air guide plate ensures that the excess compressed air from the transport nozzle is diverted away from the filter material. Because the loose endless filter rod reacts sensitively to the compressed air flowing out of the transport nozzle, this measure significantly increases the smooth running of the endless filter rod which also has a positive effect on the quality and homogeneity of the endless filter rod, and leads to an increase of the possible advancement speed of the endless rod. In particular, with the use of a funnel as a guide element, the air guide plate prevents the compressed air from the transport nozzle, which is directed in the endless rod conveying direction, from getting caught in the funnel.

Advantageously, a garniture tongue and an object insertion apparatus, which defines an object transfer position in the conveying direction of the endless filter rod downstream of the guide tube, are arranged in the conveying direction downstream of the guide tube.

Alternatively or in addition to this, the object underlying the invention is solved by an apparatus for producing an endless filter rod of the tobacco processing industry comprising a transport nozzle that can be loaded or pressurized with compressed air, a guide tube with an elongated rod arranged in the guide tube, wherein an infeed roller that is not driven but rotates freely is arranged directly at the end of the transport nozzle and at a distance to the rod, the bearing surface of which defines in sections the conveying path of the filter material web, in particular by a previously described apparatus according to the invention for producing an endless filter rod of the tobacco processing industry that is further developed in that at the end of the transport nozzle, a guide channel is arranged, the cross-section of which in the conveying direction of the endless filter rod is adapted at the input side to a cross-section of the transport nozzle, and on the output side is substantially rectangular, wherein the cross-section at an outlet of the guide channel is tapered in the vertical direction, wherein at least one forming element is formed and arranged at or in the region of a top side of the guide channel in order to contact and to concavely curve the endless filter rod during the conveyance thereof at the top side of the endless filter rod.

Embodiments of the invention are based on the fundamental idea that via the guide channel, the endless filter rod exiting from the transport nozzle is widened and, in particular, is made substantially flat, and obtains a pre-curving in order to subsequently adopts a reproducible U-shape over possibly the entire length of the endless filter rod, when it is brought onto the elongated rod in the guide tube. This, in particular, reproducible U-shape has the advantage that capsules, which are inserted into the endless filter material rod, are held there particularly reliably. With this, a precise and reproducible capsule positioning can be obtained.

The tapering in the vertical direction ensures that the endless filter rod runs around on the infeed roller as a flat web.

The guide channel is preferably connected airtight on the input side to the transport nozzle. This means that the air, which is used in the transport nozzle for conveying the endless filter rod, also runs substantially completely through the guide channel, and exits at the outlet thereof. Because the guide channel is tapered in the vertical direction at the outlet thereof and is substantially rectangular at the output side, the guide channel has the shape of a nozzle so that possibly the guide plate for diverting the air can be omitted, especially as the air can exit in one direction and not be non-uniformly distributed.

The guidance of the transport air through the guide channel also serves the further guidance and the further transport of the endless filter rod, while it forms in the guide channel corresponding to the forming of the guide channel.

The guide channel in the conveying direction of the endless filter rod preferably has a cross-section tapering in the vertical direction. This corresponds in turn to the shape of a nozzle and supports the gradual shaping of the endless filter rod into the desired output shape.

In an advantageous development in which it is possible to flexibly react to format changes, it is provided that the guide channel has one or more adjustably movable walls and/or wall sections with which a width and/or a height of the outlet is, or are, adjustable.

In a preferred embodiment a or the forming element is designed as a forming body that contacts the endless filter rod downstream of the outlet of the guide channel. Such a forming body can be attached, or respectively fastened, to the guide channel or arranged and fastened independently from the guide channel downstream of the outlet.

For contacting the filter material, the forming body preferably has a curved surface. The curved surface, which is also a contact surface, confers to the top side of the spread out endless filter rod the desired curvature that favors the subsequent rolling up of the endless filter rod.

In an advantageous development, the forming body is arranged movable with respect to a holder, in particular on a lever arm, wherein the forming body, in particular using the lever arm, can be force-loaded with respect to the holder, in particular spring-loaded, in order to press the forming body against the top side of the endless filter rod with a substantially constant force. This embodiment has the advantage that the filter material, which is varying in the density and thickness thereof in the course of the removal from a filter material store, is curved with a constant force so that the resistance which is exerted due to the procedure of the curving of the top side of the endless filter rod does not fluctuate such that this disrupts the process of the rod formation.

In an alternative or additional design, it is also preferably provided that a or the forming element is a part of the outlet of the guide channel, wherein the outlet has a form opening with a curved top side. The curved top side is thus a part of the outlet such that the outlet opening itself confers the curved shape on the top side. This can be supported by a previously described forming body that engages downstream of the outlet. Both the variant with the forming body as well as the variant with the forming element in the form of an appropriate form opening in the outlet of the guide channel permit adjustment to different endless rod formats, if for example, the top side of the guide channel is movable with respect to the further sides, or for example, together with the side surfaces is movable with respect to a bottom side. The forming body can also be appropriately adapted in the positioning thereof.

Advantageously the curved top side is designed as a bent edge of the outlet, wherein the bent edge is designed as a kinked or bent part of an upper side wall of the guide channel, or as an ending of a curved upper side wall of the guide channel in the region of the outlet. In both cases, the outlet opening in the middle is smaller in the vertical direction than at the edges. If the upper side wall is already appropriately curved before the outlet, a gradual curving of the endless filter rod is possible, which in the case of a bent part at the location of the outlet is generated rather instantly on the conveying path.

The guide channel and/or the at least one guide element is preferably made of metal, a metal alloy or a plastic and/or contains a metal, a metal alloy, or a plastic at least to some extent.

The guide channel is preferably substantially transparent. This means that the rod formation and the endless filter rod can be observed in the guide channel even during the production thereof.

Embodiments of the invention address the known drawbacks of the known art by an endless filter rod machine of the tobacco processing industry with a previously described apparatus according to the invention.

Further, embodiments of the invention are directed to a method for producing an endless filter rod of the tobacco processing industry. The method includes a filter material web is conveyed under feeding of compressed air by a transport nozzle to a guide tube with an elongated rod arranged in the guide tube, such that the filter material web directly at the end of the transport nozzle and at a distance to the rod is deflected using an infeed roller that is not driven but rotates freely and the bearing surface of which defines in sections the conveying path of the filter material web, the filter material web is guided to the rod between the infeed roller and the rod via a further guide element, by which a cross-section of the filter material web is reduced between the rod and the further guide element in the region of a rod projection of the rod.

Alternatively or in addition to this, embodiments of the invention are directed to a method for producing an endless filter rod of the tobacco processing industry. A filter material web is conveyed under feeding of compressed air through a transport nozzle to a guide tube with an elongated rod arranged in the guide tube, and the filter material web directly at the end of the transport nozzle and at a distance to the rod is deflected using an infeed roller that is not driven but rotates freely and the bearing surface of which defines in sections the conveying path of the filter material web. Further, the filter material web at the end of the transport nozzle is conveyed through a guide channel whose cross-section in the conveying direction of the endless filter rod is adapted at the input side to a cross-section of the transport nozzle and at the output side is substantially rectangular. The cross-section is tapered in the vertical direction at an outlet of the guide channel. At least one forming element is formed and arranged at or in the region of a top side of the guide channel that contacts and concavely curves the endless filter rod during conveyance thereof at the top side of the endless filter rod, and/or that the filter material web is guided to the rod between the infeed roller and the rod via a further guide element and by which the rod a cross-section of the filter material web is reduced between the rod and the further guide element in the region of a rod projection of the rod.

Objects are advantageously inserted into the filter material web downstream of the guide tube. With the method, the filter material web is advantageously conveyed through a previously described apparatus according to the invention.

The features, properties, and advantages named for the individual invention objects, thus the apparatus, the endless filter rod machine and the method, also apply without restriction to the respective other invention objects, which relate to each other.

Further features of the invention will become apparent from the description of the embodiments according to the invention together with the claims and the included drawings. Embodiments according to the invention can fulfill individual characteristics or a combination of several characteristics.

Embodiments of the invention are directed to an apparatus for producing an endless filter rod of the tobacco processing industry. The apparatus includes a transport nozzle loadable with compressed air, a guide tube, an elongated rod, which is arranged in the guide tube, having a rod projection, and an infeed roller, which is non-driven and freely rotatable, positioned immediately at an end of the transport nozzle and at a distance to the rod, and has a bearing surface that defines in sections a conveying path of a filter material web. The apparatus also includes a guide element positioned between the infeed roller and the rod by which a cross-section of the filter material web is reduced between the rod and the guide element in a region of the rod projection.

According to embodiments, the guide element can be structured and arranged as a freely rotatable, non-driven guide roller that is arranged below the rod projection. Further, an axis of rotation of the guide roller may be arranged parallel to an axis of rotation of the infeed roller and offset downward in direction of gravity.

In accordance with other embodiments, the guide element can be structured and arranged as a funnel, which opens into the guide tube.

According to other embodiments of the invention, at least one of the infeed roller and the guide roller can have a bearing surface with a central peripheral ridge having a largest radius that is 10% to 100% greater than a smallest radius of the bearing surface. Further, the largest radius of the central peripheral ridge may be 20% to 50% greater than the smallest radius of the bearing surface.

In embodiments, the apparatus can also include an air guide plate arranged, in relation to a conveying direction, downstream of at least one of the transport nozzle and the infeed roller, upstream of the rod and above a conveying path of the endless filter rod.

In further embodiments of the invention, the apparatus may also include a garniture tongue and an object inserter arranged, in relation to a conveying direction, downstream of the guide tube, to provide an object transfer position.

According to still other embodiments, the rod projection, in relation to the conveying direction, can extend upstream from the rod.

Embodiments of the invention are directed to an apparatus for producing an endless filter rod of the tobacco processing industry. The apparatus includes a transport nozzle loadable with compressed air, a guide tube, an elongated rod arranged in the guide tube, and an infeed roller, which is non-driven and freely rotatable, being arranged immediately at an end of the transport nozzle and at a distance to the rod, and having a bearing surface that defines in sections a conveying path of a filter material web. The apparatus also includes a guide channel, arranged at an end of the transport nozzle, having an input side with a cross-section normal to the conveying direction adapted to a cross-section of the transport nozzle, and an output side with a cross-section normal to the conveying direction that is substantially rectangular, an outlet of the guide channel has a cross-section normal to the conveying direction that tapers in a vertical direction, and at least one forming element being arranged at or in a region of a top side of the guide channel that is structured and arranged to contact and concavely curve the endless filter rod on a top side of the endless filter rod during a conveying of the endless filter rod.

According to embodiments, the guide channel can be connected in an airtight manner on the input side to the transport nozzle.

In accordance with other embodiments of the invention, the guide channel may have a cross-section in the conveying direction that tapers in the vertical direction.

Further, the guide channel may have at least one of an adjustably movable wall and adjustably movable wall section that is structured and arranged with at least one of an adjustable outlet width and adjustable outlet height.

In other embodiments, the at least one forming element is structured and arranged as a forming body that contacts the endless filter rod downstream of the outlet of the guide channel. The forming body for contacting the filter material can have a curved surface. Further, the forming body can be structured and arranged to be movable with respect to a holder and to be force-loaded with respect to the holder to press the forming body against the top side of the endless filter rod with a substantially constant force. The forming body can be structured and arranged on a lever arm to be spring-loaded against the top side of the endless filter rod.

According to still further embodiments, the forming element may be a part of the outlet of the guide channel, and wherein the outlet has a form opening with a curved top side. The curved top side can be structured and arranged as a bent edge of the outlet that is designed one of as a kinked or bent part of an upper side wall of the guide channel and as an ending of a curved upper sidewall of the guide channel in the region of the outlet.

In accordance with still other embodiments, the at least one the guide channel and the at least one forming element can be produced from a material comprising at least one of a metal, a metal alloy and a plastic.

In accordance with other embodiments of the invention, the guide channel can be substantially transparent.

Embodiments of the invention are directed to an endless filter rod machine of the tobacco processing industry that includes one of the above-described embodiments of the apparatus.

Embodiments are directed to a method for producing an endless filter rod of the tobacco processing industry. The method includes conveying a filter material web by compressed air through a transport nozzle to a guide tube having an elongated rod arranged therein, and diverting the filter material web via a non-driven and freely rotating infeed roller arranged directly at an output of the transport nozzle and at a distance to the rod, the infeed roller including a bearing surface defining in sections a conveying path of the filter material web. The method also includes guiding the filter material web to the rod via a guide element, which is arranged between the infeed roller and the rod, that is structured and arranged to reduce a cross-section of the filter material web between the rod and the guide element in a region of a rod projection of the rod.

According to embodiments, the method can also include inserting objects into the filter material web, in relation to the conveying direction, downstream of the guide tube.

In accordance with other embodiments of the invention, the filter material web may be conveyed through an apparatus for producing an endless filter rod of the tobacco processing industry.

Embodiments of the invention are directed to a method for producing an endless filter rod of the tobacco processing industry. The method includes conveying a filter material web via compressed air through a transport nozzle to a guide tube with an elongated rod arranged in the guide tube, and diverting the filter material web via a freely rotatable infeed roller arranged at an end of the transport nozzle and at a distance to the rod, the infeed roller having a bearing surface defining in sections a conveying path of the filter material web. The method also includes conveying the filter material web at an end of the transport nozzle through a guide channel having an input side with a cross-section normal to the conveying direction adapted to a cross-section of the transport nozzle, an output side with a cross-section normal to the conveying direction that is substantially rectangular, and an outlet with a cross-section normal to the conveying direction that is tapered in the vertical direction, and contacting and concavely curving a top side of the endless filter rod while conveying the endless filter rod with at least one forming element structured and arranged at or in the region of a top side of the guide channel.

In accordance with still yet other embodiments of the present invention, the method can also include inserting objects into the filter material web downstream of the guide tube.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
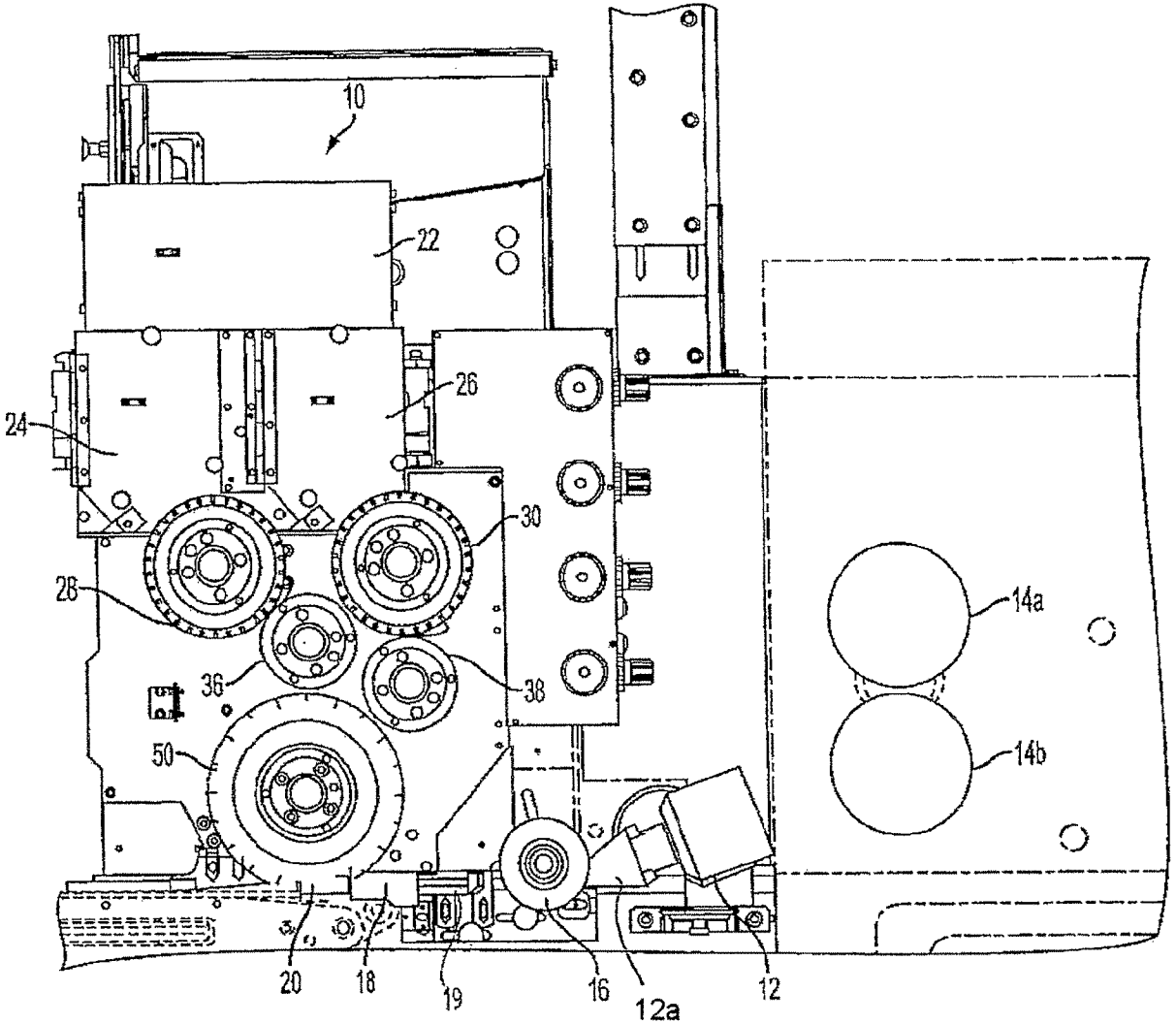
FIG. 1 (Prior Art)
FIG. 1 illustrates a side view of an object insertion apparatus according to the prior art.

FIG. 1 shows, in an example, an endless rod forming apparatus with an object insertion apparatus 10 known from the document EP 2 502 510 A1 from the applicant. The rod conveying direction in FIG. 1 generally runs from right to left. A band of endless filter material, e.g. filter tow, not shown, is processed in the processing apparatus shown on the right (without reference number) and is conveyed via two delivery rollers 14*a*, 14*b* to a transport nozzle 12. In the transport nozzle 12, the band of filter material is compressed in cross-section and with a large quantity of compressed air is conveyed to a tow guide 18, which has a central rod 19, around which the filter tow in the tow guide 18 is wrapped, or respectively folded.

The transport nozzle 12 doses the endless band of filter material, e.g. filter tow, from the pair of delivery rollers 14*a*, 14*b* initially to an infeed roller 16, which has a substantially U-shaped or V-shaped peripheral profile that bends and folds the filter material while it runs over the infeed roller 16. The infeed roller 16 feeds the filter material to the tow guide 18 and then to a garniture tongue 20 lying downstream, or respectively behind, in the endless rod conveying direction. After it leaves the garniture tongue 20, the filter material arrives through the remainder of the endless rod and rod forming unit (not shown).

The tow guide 18 opens into a garniture tongue 20 having a reduced inner dimension, in which the endless filter rod is further narrowed and sealed. The split garniture tongue 20 has a slot-like recess on the top side thereof into which an inserter wheel 50 of an object insertion apparatus 10 engages in order to insert objects into the endless filter rod. Due to the combination of rod 19 and tow guide 18, the endless filter rod at this location has a U-shaped cross-section with an upward pointing fold that reaches up to the center of the endless filter rod so that the objects can be inserted easily into the fold of the endless filter rod. The objects are held in the fold in the endless filter rod. The object inserter 10 is arranged upstream in the conveying direction, or respectively in front of a conventional rod forming unit, not shown (on the right in FIG. 1).

The endless filter rod is then divided using a rod cutting apparatus (not shown) into a plurality of rod portions in each of which at least one or more objects are located. The rod portions can be collected for further processing in a collection apparatus, or can be transported directly to a cigarette making machine.

The object insertion apparatus 10 in the configuration shown in FIG. 1 comprises a storage apparatus 22, such as one or more hoppers, which store a plurality of objects to be inserted into the filter material. The objects are substantially spherical in shape for example, and may be referred to as capsules, however, other shapes and configurations are possible. For ease of representation, the objects in this document in the scope of the present apparatus will be referred to as "capsules".

The storage apparatus 22 feeds the capsules to one or more feed chambers 24, 26, which in turn feed the capsules to first and second metering wheels 28, 30. The feed chamber 24 and/or the feed chamber 26 comprise a "single plane" feed chamber that feeds only a single plane of capsules to the periphery of the respective metering wheels 28, 30. For example, the capsules passing through the "single plane" feed chamber are confined to an arrangement that is multiple capsules high, and multiple capsules deep, but only a single capsule wide.

The apparatus 10 comprises further intermediate wheels 36, 38, which receive capsules that are transferred from the metering wheels 28, 30. An inserter wheel 50 receives capsules from the intermediate wheels 36, 38 and inserts them into the band of filter material, when it enters through the tongue 20. The arrangement of the metering wheels 28, 30, intermediate wheels 36, 38, and inserter wheels 50 described above helps to enable faster operation of the object inserter 10.

Figure 2:
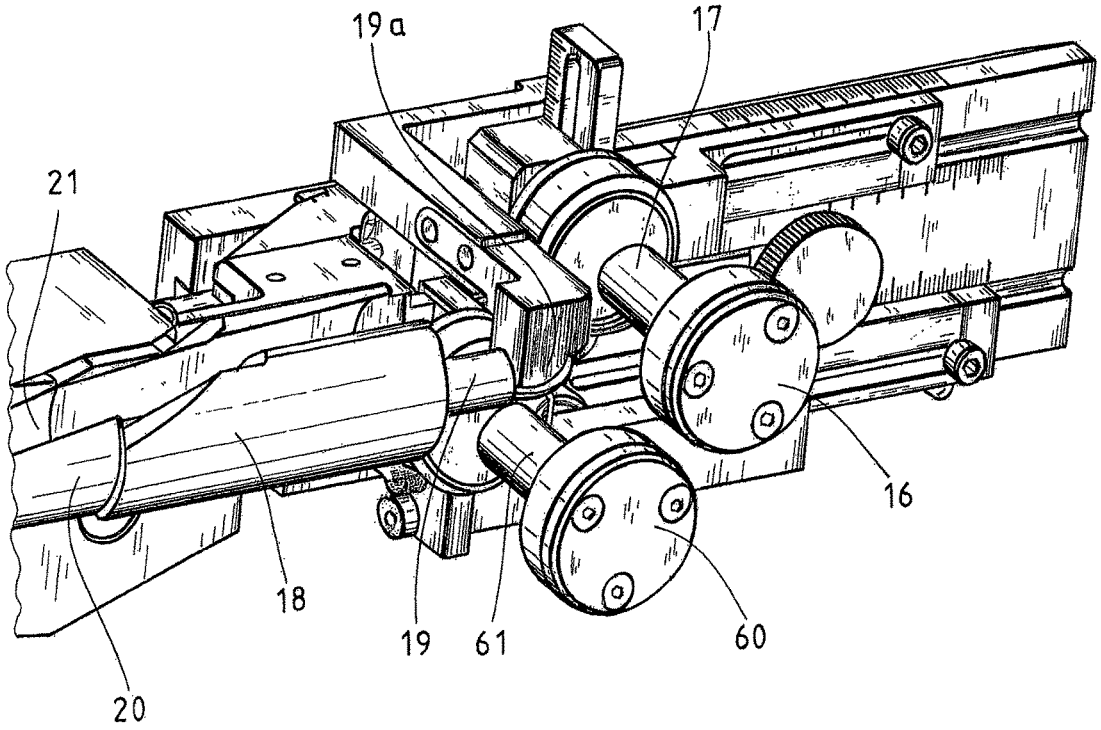
FIG. 2 illustrates a perspective representation of a first embodiment according to the invention.

FIG. 2 shows a schematic perspective representation of a first embodiment of an apparatus according to the invention for producing an endless filter rod, wherein the transport nozzle 12 shown in FIG. 1 is omitted for reasons of clarity.

At the location, at which the infeed roller 16 is arranged in FIG. 1, there is likewise in FIG. 2 an infeed roller 16, the bearing surface 17 of which, however, has a smaller diameter than the infeed roller 16 from FIG. 1.

The infeed roller in FIG. 2 is arranged with respect to the transport nozzle 12, not shown, so that the loose, or respectively still loose, endless filter rod, upon exiting the transport nozzle 12 and the air outlet funnel 12*a*, which is a part of the transport nozzle 12, arrives on the bottom side of the bearing surface 17 of the infeed roller 16. The infeed roller 16 is mounted freely rotating and is not driven so that it co-rotates freely with the endless filter rod, thus clockwise in the perspective represented in FIG. 2. The endless filter rod, not shown, arrives from the bottom side of the bearing surface 17 of the infeed roller 16 to the top side of the bearing surface 61 of a guide roller 60, likewise mounted freely rotatable and not driven, which is arranged below the rod projection 19*a*, or respectively the beginning of the rod 19, which is arranged in the further progression within the guide tube 18. Thus, the guide roller 60 in the view according to FIG. 2 rotates in the counterclockwise direction.

The rod 19 and the guide tube 18 as well as the downstream subsequent garniture tongue 20 are designed the same or similar to those known from the prior art according to FIG. 1. The rod projection 19*a* has the shape of a bent plow with a flat cutting edge and is also called a plow.

The endless filter rod is guided through the intermediate space between the rod 19, or respectively the plow thereof on one side and the bearing surface 61 of the guide roller 60 on the other side, so that it contacts the top side of the bearing surface 61 of the guide roller 60 and is guided and shaped thereby. Using the bearing surface 61 of the guide roller 60, the cross-section available for the endless filter rod is reduced with respect to the arrangement from FIG. 1 and thereby the endless filter rod is both guided, which positively influences the smooth running, as well as restricted in cross-section which leads to a compaction of the filter material in the endless filter rod and to an increased pressure drop in the finished product.

The path of the endless filter rod past the infeed roller 16 and the guide roller 60 is therefore the same as a baffle, wherein the endless filter rod is deflected and formed at both rollers 16, 60, in particular flattened.

Figure 3:
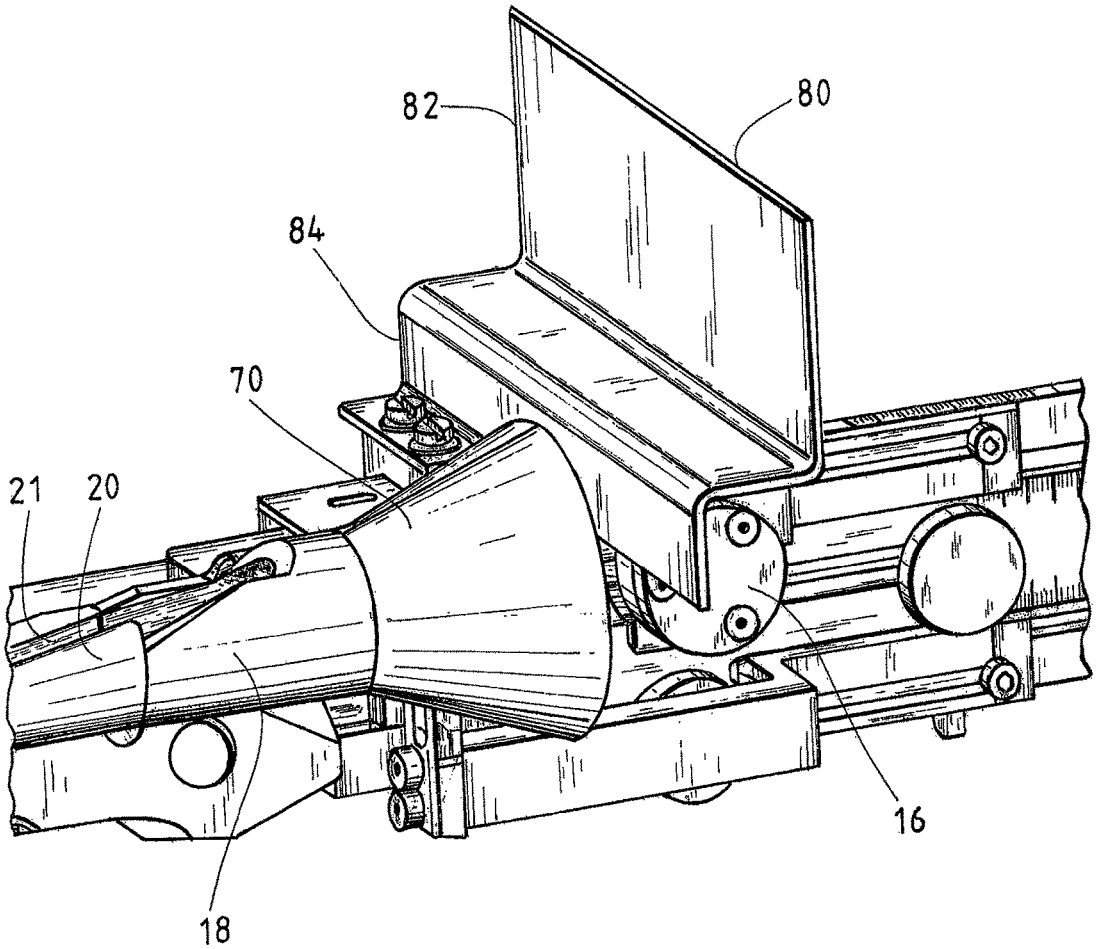
FIG. 3 illustrates a perspective representation of a second embodiment according to the invention.

FIG. 3 shows an alternative second exemplary embodiment of an apparatus according to the invention. As in the exemplary embodiment according to FIG. 2, an infeed roller 16 is arranged at the same location and with the same dimensions with regard to the guide tube 18, at the end of the transport nozzle 12, not shown. In the exemplary embodiment according to FIG. 3, a funnel 70 is provided as a guide element that receives the loose endless filter rod downstream of the infeed roller 16 with a comparatively small opening angle and feeds it to the guide tube 18 and the rod 19 arranged therein, not shown, because it is covered in perspective. Thereby, the funnel 70 takes on the task of guiding, pre-forming and pre-compacting the loose endless filter rod, because the funnel 70 reduces the distance and the available cross-section to the rod 19 in a gentle manner.

In order that the funnel 70 does not reduce the large quantity of compressed air from the transport nozzle 12, not shown, and with this disrupt the smooth running of the endless filter rod, an air guide plate 80 is provided which diverts a large portion of the compressed air away from the funnel 70 and the endless filter rod, not shown. In the exemplary embodiment shown in FIG. 3, the air guide plate 80 has an upper section 82 and a lower section 84, wherein the lower section 84 is arranged offset downstream in the rod conveying direction with respect to the upper section 82. With this, the air guide plate 80 engages at the input of the funnel and downstream of the infeed roller 16, while the upper section 82 has a smaller spacing to the transport nozzle, not shown, and in this manner diverts air exiting from the transport nozzle away from the endless filter rod.

Figure 4:
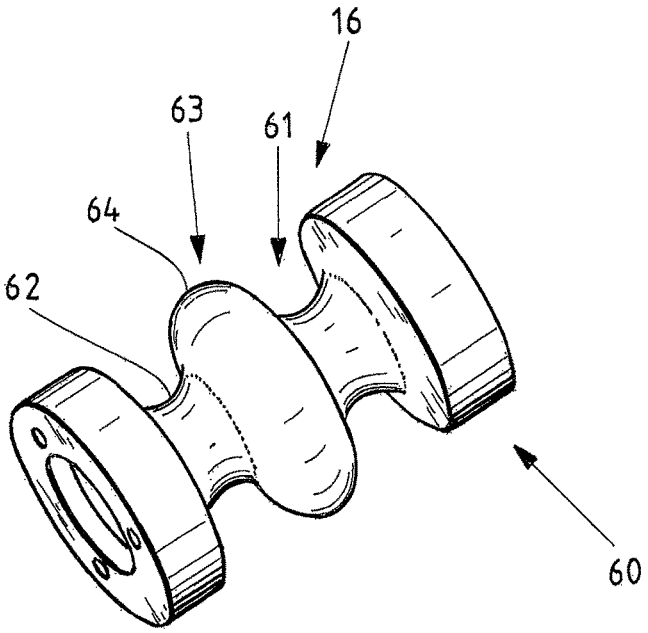
FIG. 4 illustrates a perspective representation of a roller with a ridge.

FIG. 4 shows a schematic perspective representation of a roller, in this case a roller that can be used as an infeed roller 16 or as a guide roller 60, the bearing surface 61 of which has a ridge 63. The ridge 63 is arranged centrally on the bearing surface 61 between two edge limiting sections with increased radius, and has a largest radius 64 which is significantly larger than the smallest radius 62 of the bearing surface 61 on both sides of the ridge 63. The endless filter rod is led centrally over the ridge 63 and thus, is preformed and compacted, which leads to an increase in the pressure drop of the finished filter. With the ratio of the largest radius 64, or respectively greatest diameter, to the smallest radius 62, or respectively smallest diameter, there is a compromise to be attained between the thusly achievable degree of pre-shaping and pre-compacting and the smooth running of the endless filter rod, namely the danger that the endless filter rod slips off from the ridge 63 and arrives on the left or right in a region of the bearing surface 61 with smaller radius 62. Both depend on the condition of the filter material web, or respectively the loose endless filter rod, at the end of the transport nozzle.

Figure 5:
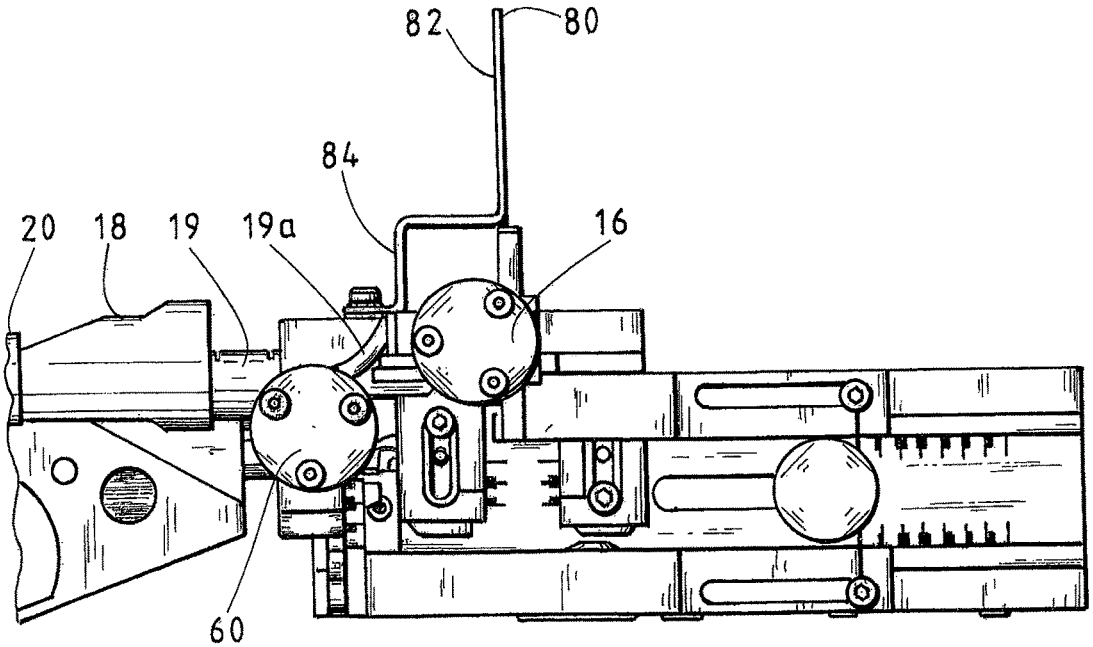
FIG. 5 illustrates a side view of a third embodiment according to the invention.

FIG. 5 shows a third exemplary embodiment of an apparatus according to the invention according to the invention, which connects together the elements of the exemplary embodiments from FIGS. 2 and 3. The side view shows, again with omission of the transport nozzle 12, the arrangement of similar infeed roller 16 and guide roller 60, wherein the guide roller 60 is arranged behind and below the infeed roller 16. In the conveying direction, the infeed roller 16 is arranged directly at the end of the transport nozzle 12 and the guide roller 60 is arranged below the beginning of the rod 19.

FIG. 5 clearly shows that the rod 19 has an elongated cylindrical part and at its beginning, that is in the endless rod conveying direction, that part which first encounters the endless filter rod, has a rounded off edge at the rod projection 19*a* thereof which serves the guidance of the endless filter rod to the rod 19 and the creation of a fold in the endless filter rod.

The guide roller 60 is arranged below the rod projection 19*a*, or respectively the plow, in order to define together with the leading part of the rod 19, or respectively the rod projection 19*a*, a cross-section that is somewhat narrower than the cross-section of the arriving endless filter rod. Thereby, the loose endless filter rod is compressed and guided and pre-formed in order to subsequently wrap around the rod 19 within the guide tube 18 and thus to obtain the characteristic U-shaped cross-section thereof. In this respect, the exemplary embodiment according to FIG. 5 corresponds to that of FIG. 2.

In addition, in this exemplary embodiment, as in that of FIG. 3, an air guide plate 80 having an upper section 82 and a lower section 84 offset downstream in the conveying direction is also provided, that is, arranged above the infeed roller 16, and diverts a large portion of the compressed air directed upwards from the transport nozzle, not shown, away from the endless filter rod.

The remaining parts, not provided with reference numbers, of the design at which the rollers 16, 60 and the air guide plate 80 are arranged, serve for adjusting the positioning of the rollers 16, 60 and the air guide plate 80 with respect to the downstream arranged components.

FIG. 6*a*) shows schematically a side view of an arrangement of transport nozzle 12, guide channel 100 according to the invention and forming element 110. An endless filter rod, or respectively filter material web, not shown, is conveyed through the transport nozzle 12, under feeding of compressed air, and is compressed to an endless rod. At the outlet of the transport nozzle, a guide channel 100 according to the invention is attached which covers the outlet that is not shown in FIG. 6*a*). The abutting edge, at which the guide channel 100 abuts the transport nozzle 12 is sealed substantially or completely airtight with a transition seal 102 such that the transport air exiting out of the transport nozzle 12 substantially or completely enters through the guide channel 100.

The guide channel 100 at the upstream end thereof is adapted to the peripheral contour of the transport nozzle 12 in the region of the transition seal 102. With the outlet 104, on the output side, the transport nozzle 100 is substantially rectangular, wherein a tapering has occurred in the vertical direction, while in the horizontal direction the cross-section has either not tapered or only minimally tapered, or is enlarged. The exemplary embodiment according to FIG. 6, as in FIG. 6*b*), has a constant horizontal cross-section.

On the top side of the guide channel 100, a holder 118 is attached to which a lever arm 116 with a forming element 110 is arranged and fastened in an articulated manner. The articulated fastening allows a pivoting of the lever arm 116 with the forming element 110, as is represented by the double arrow in FIG. 6*a*). The forming element 110 is designed as a forming body 112 which at the lower side thereof has a surface 114 curved in the conveying direction and crosswise to the conveying direction. In the course of the endless rod production, this curved surface 114 of the forming body 112 contacts the top side of the endless filter rod which exits from the opening 104 of the guide channel 100 and confers a concave curvature to this top side of the endless filter rod. The thusly pre-curved endless filter rod, as described with the FIGS. 1 to 5, is initially curved in a U-shape. Then, capsules are inserted and the endless filter rod is closed around the capsules.

FIG. 6*c*) shows a perspective schematic representation of a corresponding forming element 110. This forming element 110 is preferably fastened to the holder 118 in an articulated manner using spring force so that the spring force presses the curved surface 114 of the forming body 112 into the top surface, or respectively top side, of the endless filter rod.

Figure 6:
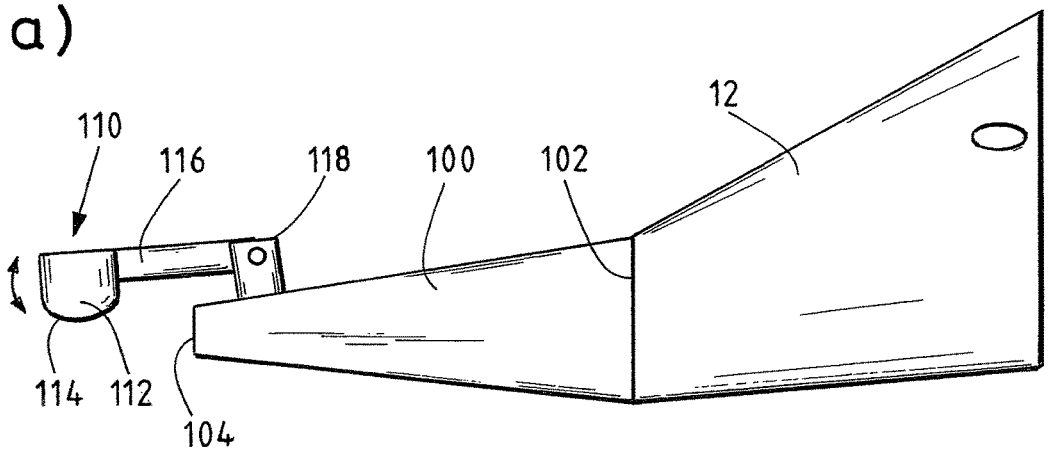
FIGS. 6*a*-6*c* schematically illustrate a guide channel according to the invention.
Figure 6:
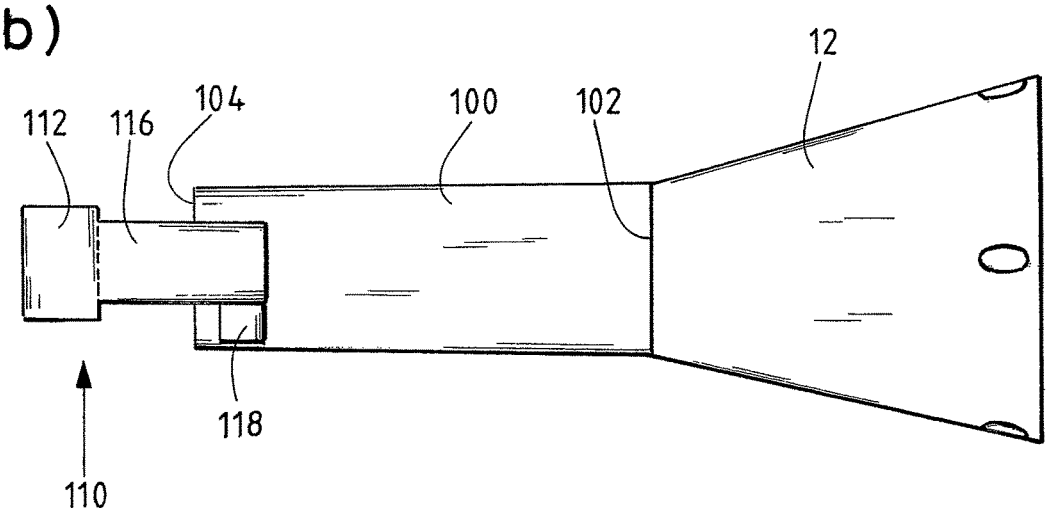
Figure 6:
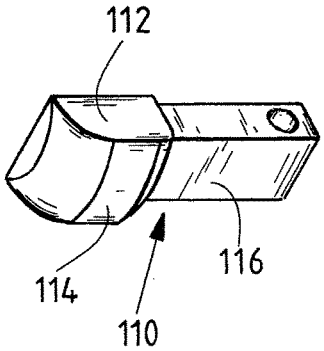

FIG. 7*a*) shows an alternative exemplary embodiment that can however also be combined with the forming body 112 according to FIG. 6, FIG. 7*a*) schematically shows a front view, whereas FIG. 7*b*) shows a cross sectional representation in the longitudinal direction.

FIG. 7*a*) schematically shows that a guide channel 100' attaches onto the transport nozzle 12. The top side and the bottom side (without reference numbers) of the guide channel 100' and the outlet 104, which is designed as a guide element 120, can be seen. This outlet 104 is substantially rectangular, wherein the horizontal dimension is larger than the vertical dimension. Typical widths for this are approximately 3 cm, whereas the vertical dimension, depending on the format of the article to be produced, can vary between 0.5 cm and 2 cm. Exact dimensioning is set based on the conditions of the filter material, the desired format and the upstream and downstream components of the machine.

The forming element 120 has a curved edge 122 as an essential component which can be an extension of the top side of the guide channel 110, and the end edge of which is rounded off so that the form opening 124 which is also the outlet opening of the guide channel has a corresponding shape in which the top side is curved inwards.

FIG. 7*b*) shows a section along the line A-A from FIG. 7*a*). Here, the outer hull of the transport nozzle 12 is shown which transitions into the guide channel 100' that is connected airtight or substantially airtight with a transition seal 112. In cross-section it can also be seen that the topside at the outlet 104 of the guide channel 100' transitions in the curved edge 122 so that only a slit remains of the form opening 124. This is the smallest opening because it runs through the center, or respectively the middle, of the guide channel 100'. Preferably there is a continuous transition with respect to the step-like transition shown in FIG. 7*b*).

The guide channels and/or the forming elements can be made of a suitable material. Possibilities are metal or metal alloys including aluminum, steel or other commonly used materials. However, they can also be composed of plastics, which in particular are abrasion resistant with respect to the filter material.

Figure 7:
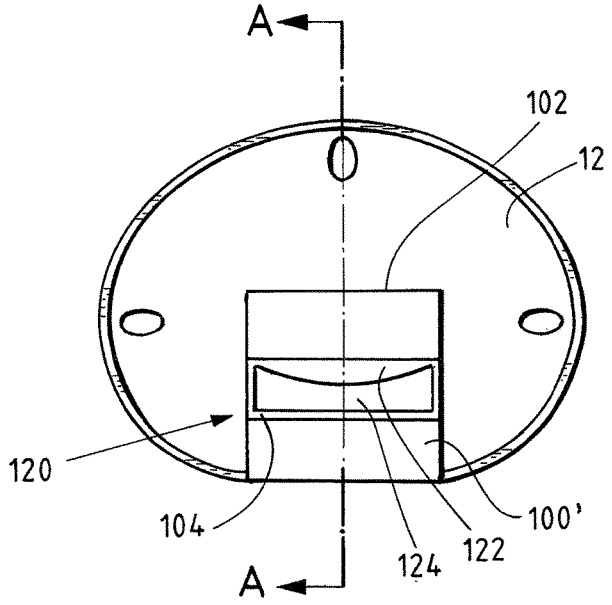
FIGS. 7*a* and 7*b* schematically illustrate a further guide channel according to the invention.
Figure 7:
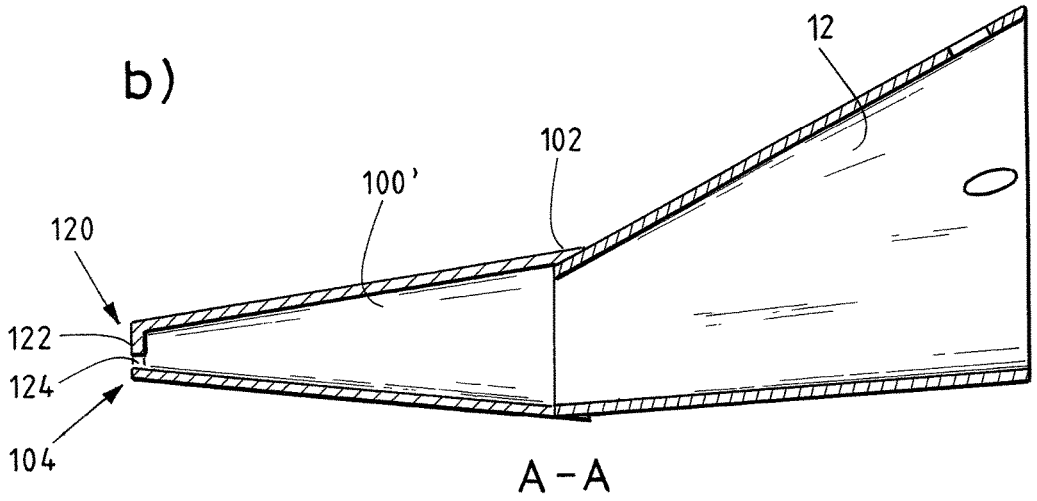

The exemplary embodiments of guide channels 100, 100' and forming elements 110, 120 shown in the FIGS. 6 and 7 can also be used with the further guide elements according to the invention which are arranged between the infeed roller and the rod, and by which a cross-section of the filter material web is reduced between the rod and the further guide element in the region of a rod projection of the rod. This increases the smooth running so that due to the increased smooth running and the pre-forming a particularly reliable process and reproducible insertion positions of the capsules to be inserted are attained.

All named characteristics, including those taken from the drawings alone, and individual characteristics, which are disclosed in combination with other characteristics, are considered individually and in combination as essential to the invention. Embodiments according to the invention can be fulfilled through individual characteristics or a combination of several characteristics.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

REFERENCE LIST

10 object insertion apparatus
12 transport nozzle
12*a* air outlet funnel
14*a*, 14*b* delivery rollers
16 infeed roller
17 bearing surface
18 tow guide
19 rod
19*a* rod projection
20 tongue
21 slot
22 storage apparatus
24, 26 feed chamber
28, 30 first/second metering wheel
36, 38 intermediate wheels
50 inserter wheel
60 guide roller
61 bearing surface
62 smallest radius of the bearing surface
63 ridge
64 largest radius of the bearing surface
70 funnel
80 air guide plate
82 upper section
84 lower section
100, 100' guide channel
102 transition seal
104 outlet
110 forming element
112 forming body
114 curved surface

116 lever arm
118 holder
120 forming element
122 bent edge
124 form opening

What is claimed:

1. An apparatus for producing an endless filter rod of the tobacco processing industry comprising:

a transport nozzle loadable with compressed air;

a guide tube;

an elongated rod, which is arranged in the guide tube, having a rod projection;

an infeed roller, which is non-driven and freely rotatable, being positioned immediately at an end of the transport nozzle and at a distance to the rod, and includes a bearing surface; and a guide element positioned below the rod projection and between the infeed roller and the rod to reduce a cross-section of the filter material web between the rod and the guide element in a region of the rod projection, wherein at least a part of a conveying path of a filter material web extends, in order, through the transport nozzle, along the bearing surface of the infeed roller, and past the guide element to in between the rod and the guide tube.

2. The apparatus according to claim 1, wherein the guide element is structured and arranged as a freely rotatable, non-driven guide roller.

3. The apparatus according to claim 2, wherein an axis of rotation of the guide roller is arranged parallel to an axis of rotation of the infeed roller and offset downward in direction of gravity.

4. The apparatus according to claim 1, wherein the guide element is structured and arranged as a funnel, which opens into the guide tube.

5. The apparatus according to claim 1, wherein at least one of the infeed roller and the guide roller has a bearing surface with a central peripheral ridge having a largest radius that is 10% to 100% greater than a smallest radius of the bearing surface.

6. The apparatus according to claim 5, wherein the largest radius of the central peripheral ridge is 20% to 50% greater than the smallest radius of the bearing surface.

7. The apparatus according to claim 1, further comprising an air guide plate being arranged, in relation to a conveying direction, downstream of at least one of the transport nozzle and the infeed roller, upstream of the rod and above a conveying path of the endless filter rod.

8. The apparatus according to claim 1, further comprising a garniture tongue and an object inserter being arranged, in relation to a conveying direction, downstream of the guide tube, to provide an object transfer position.

9. The apparatus according to claim 1, wherein the rod projection, in relation to the conveying direction, extends upstream from the rod.

10. An endless filter rod machine of the tobacco processing industry comprising the apparatus according to claim 1.

* * * * *